United States Patent [19]

Grimm

[11] Patent Number: 4,545,152

[45] Date of Patent: Oct. 8, 1985

[54] GRINDING APPARATUS

[75] Inventor: Hans Grimm, Esslingen/Berkheim, Fed. Rep. of Germany

[73] Assignee: Maschinenfabrik Gehring, GmbH & Co. Kommanditgesellschaft, Fed. Rep. of Germany

[21] Appl. No.: 473,589

[22] Filed: Mar. 9, 1983

[30] Foreign Application Priority Data

Mar. 10, 1982 [DE] Fed. Rep. of Germany ..... 3208536

[51] Int. Cl.[4] ..... B24B 15/02

[52] U.S. Cl. ..... 51/103 R; 51/241 VS; 51/267; 51/281 P

[58] Field of Search ..... 51/103 R, 103 WH, 170 PT, 51/241 VS, 241 A, 236, 266, 267, 281 P; 384/118, 120, 121, 123

[56] References Cited

U.S. PATENT DOCUMENTS

| | | | |
|---|---|---|---|
| 1,859,737 | 5/1932 | Guild | 51/103 R X |
| 1,878,116 | 9/1932 | Deutsch | 51/103 R X |
| 1,938,330 | 12/1933 | Hall | 51/241 A |
| 2,211,216 | 8/1940 | Oster | 51/170 PT |
| 2,586,242 | 2/1952 | Mathews | 51/267 |
| 2,635,395 | 4/1953 | Arms et al. | 51/103 WH |
| 3,056,238 | 10/1962 | Hahn | 51/236 X |

FOREIGN PATENT DOCUMENTS

| | | | |
|---|---|---|---|
| 19339 | 11/1980 | European Pat. Off. | 384/120 |
| 2912814 | 10/1980 | Fed. Rep. of Germany | 51/103 R |
| 595619 | 12/1947 | United Kingdom | 51/267 |
| 640515 | 7/1950 | United Kingdom | 51/267 |
| 278457 | 4/1969 | U.S.S.R. | 51/103 R |
| 252110 | 9/1969 | U.S.S.R. | 51/105 R |
| 439636 | 3/1975 | U.S.S.R. | 384/120 |

*Primary Examiner*—Robert P. Olszewski

*Attorney, Agent, or Firm*—Schwartz, Jeffery, Schwaab, Mack, Blumenthal & Evans

[57] ABSTRACT

The grinding apparatus permits precision machining of a valve seat or a sealing surface, and includes a grinding spindle having a holding and guiding part extending into a finished workpiece bore with clearance. The holding and guiding part is smaller in diameter than the grinding spindle and includes a pin which carries on its free end a grinding tool. The other end of the pin passes into the grinding spindle which has a substantially larger diameter. The grinding spindle is located outside the bore of the workpiece and may thus be made very stable. The pin is held by the grinding spindle so that the workpiece is held and guided securely even in the case of very small workpiece diameters.

14 Claims, 4 Drawing Figures

GRINDING APPARATUS

BACKGROUND OF THE INVENTION

In a known grinding apparatus of this type (DE-OS No. 29 12 814) the holding and guiding part is a cylindrical spindle sleeve, surrounding the grinding sleeve in the area of a center hole of the workpiece. The grinding spindle carries on one of its ends the grinding tool, adapted to the inclination of a valve seat surface. This known grinding apparatus no longer satisfies the high accuracy requirements for workpieces with a relatively small center hole, the diameter of which is approximately 6 mm. or less, for example. The reason for this is the lack of stability of the arrangement. There is an increasing need to produce workpieces with very small center bores, for example, for fuel injection pump nozzle bodies.

SUMMARY OF THF INVENTION

The object of the invention is to provide a grinding apparatus of the above-mentioned type whereby even in the case of workpiece holes with very small diameters high machining accuracies may be obtained.

As the grinding spindle is arranged according to the invention outside the workpiece, its diameter may be significantly larger than the bore of the workpiece and therefore it may be extremely heavy and stable. The shaft like pin is thereby held in the grinding spindle so that the workpiece is guided and held securely even in the case of very small workpiece diameters. As the result of the configuration according to the invention, conventional, high rpm and highly accurate grinding spindles with, for example, hydrostatic or aerostatic bearing supports and a rotating velocity of 60,000 to 100,000 rpm may also be used. The rigid, high strength configuration of the spindle ensures a very high machining accuracy, satisfying the highest requirements.

Further characteristics of the invention will become apparent from the following description and the drawings.

DETAILED DESCRIPTION OF THE PREFERRED EMBODIMENTS

Figure 1:
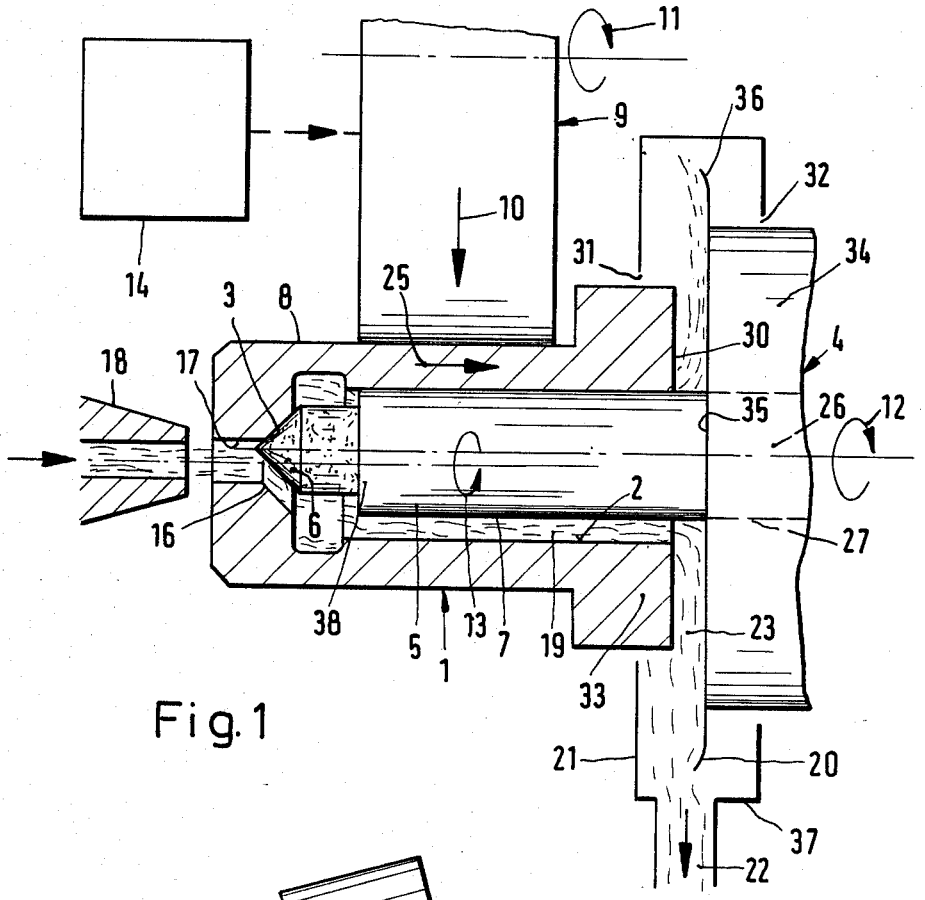
FIG. 1 shows a part of the apparatus according to the invention in an axial section.

Referring to the embodiment of FIG. 1, there is shown therein a grinding apparatus with a workpiece 1 arranged therein. The workpiece has a honed center bore 2 and a valve seat surface 3 concentric with said bore 2, with said valve seat to be ground by means of the apparatus. For the machining of the valve seat surface 3, the apparatus has a shaft-like pin 5, carrying at its front end 38 a grinding tool 6 having a grinding surface adapted to the inclination of the valve seat surface 3. The grinding pin 5 is rigidly joined to a grinding spindle 4 of the apparatus. It is clamped in a simple manner, with one end 26 outside the bore 2 in a corresponding bore 27 of the spindle 4. To improve its strength, the grinding pin 5 has a massive configuration and consists preferably entirely of a hard alloy for example, carbide, and has a circular cross section constant over its entire length. Its diameter is slightly less than the diameter of the center bore 2 and substantially smaller than the diameter of the spindle 4. The diameter of the latter is a multiple of the pin diameter, in the FIG. 1 embodiment being approximately three to four times the diameter of said pin diameter. As the result of this large diameter the spindle 4 is especially strong, so that the pin 5 itself is held securely in the spindle even during the machining of very small valve seat surfaces. This permits the valve seat surface to be processed with an extremely high accuracy.

The workpiece 1 having the valve seat surface 3 to be machined is pushed onto the grinding pin 5 manually or preferably by a device (not shown) known in the art. The workpiece is then securely held and guided in the finish honed center bore, on the pin 5.

For guidance without play and the holding of the workpiece 1, a drive part 9 having the configuration of a roll is provided. It acts on an outer circumferential surface 8 of the workpiece 1, which is concentric to the center bore 2. The workpiece 1 is thereby pressed against the circumferential surface 7 of the pin 5, and driven in rotation. The drive roll 9 may be moved or displaced by means of a device well known, in the art (not shown) for example, a hydrostatic piston-cylinder arrangement, in the direction of the workpiece 1 (arrow 10) with a predetermined, preferably continuously adjustable force. The drive roll is driven by rotating drive means, for example, a hydraulic motor (not shown) in the direction of the arrow 11. Consequently, the workpiece 1 is rotating in a direction (arrow 13) opposite to the grinding spindle 4 (arrow 12), but with a lower rpm, for example at 200 to 3000 rpm.

In order to advance the workpiece 1 in the axial direction (arrow 25), the drive roll 9 is connected with an advance drive 14, also known in the art, whereby the grinding tool 6 may be applied with a fine adjustment to the valve seat surface 3 of the workpiece 1, and the grinding pressure regulated continuously.

Figure 2:
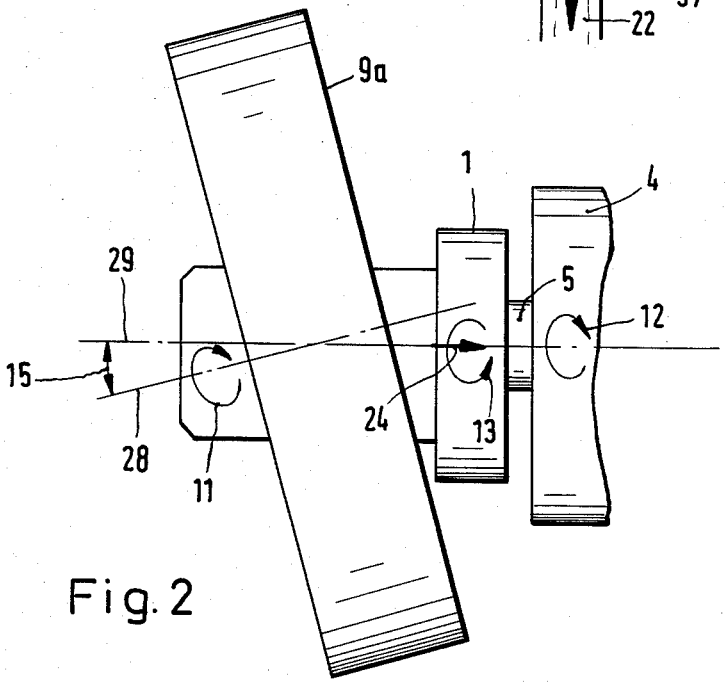
FIG. 2 is a top view of a part of a second form of embodiment of the apparatus of the invention.

As shown in FIG. 2 in a further embodiment of the invention, the axis 28 of a drive roll **9*a* is set at a predetermined acute angle 15, preferably approximately 2° to 5°, obliquely to the axis 29 of the workpiece, whereby an axial motion component is superposed on the rotation of the drive roll 9*a* in the direction of the workpiece 1 (arrow 24). By the appropriate setting and variation of the angle of inclination 15 the grinding pressure may be regulated. In place of the drive rolls 9 or 9*a***, a suitably designed belt drive may also be used.

The devices according to FIG. 1 and 2 further include a cooling medium system, of which only a nozzle 18 is shown (FIG. 1), whereby lubricating and cooling means may be introduced under a high pressure into the grinding zone 16 of the workpiece 1. The nozzle 18 is located aligned with and at a small distance from an orifice 17 of the workpiece, so that the jet of the cooling medium exiting from the nozzle 18 at a high pressure directly enters the grinding zone 16.

By means of the high pressure, the cooling and lubricating medium is further forced into the sickle-shaped gap 19 following the cutting zone 16 in the direction of advance 25, said gap remaining between the center bore 2 and the circumferential surface 7. In this gap 19, the cooling and lubricating medium forms a lubricating wedge between the pin 5 and the workpiece 1, resulting in a hydrostatically acting bearing between said parts. This bearing is highly accurate and assures only very slight friction between the shaft or pin 5 and the workpiece. The lubricating and cooling medium then exits at the frontal side 30 of the workpiece 1 facing the grinding spindle, and is conducted by way of a cover part 20 and a collecting device 21 to a return line 22.

The collecting device 21 is a flat box approximately circular in its cross section, with two coaxial passage orifices 31 and 32 in its opposed disk-shaped lateral walls. The workpiece 1 and the spindle 4 protrude, with their ends 33 and 34 facing each other, into the orifices 31 and 32. The cover part 20 has a circular configuration and is supported flat on the corresponding frontal surface 35 of the spindle end 34. The cover part has an edge 36 bent away from the spindle 4 and a diameter only slightly smaller than the collector device 21, so that the spindle 4 is satisfactorily sealed with respect to the cooling and lubricating medium. The return line 22 is connected to the cylindrical outer wall 37 of the collector device 21, and is preferably integrally formed therewith.

It is further possible to let the cooling and lubricating medium flow in the opposite direction. For this purpose, cooling means may be injected under a high pressure directly into the sickle-shaped gap 19, by means of a finger (not shown) protruding into an intermediate space 23 between the frontal side 35 of the grinding spindle 4 and the opposing frontal side 30 of the workpiece 1. The lubricant then passes into the grinding zone 16 and leaves the workpiece 1 through the orifice 17 of the workpiece. This path of the lubricant has the advantage that the abraded material does not arrive from the grinding zone 16 in the area of the bearing and guidance of the workpiece 1, but is transported directly through the workpiece bore 17 from the workpiece 1.

Figure 3:
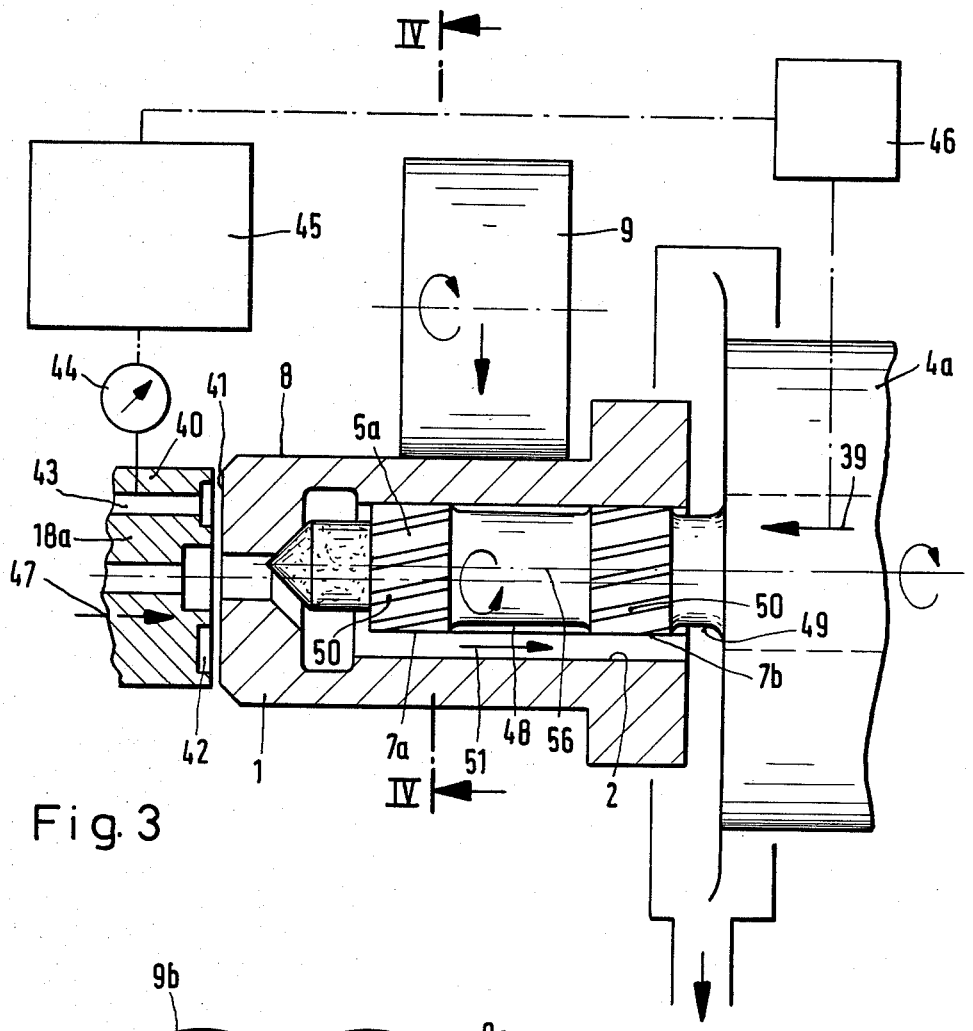
FIG. 3 is a further form of embodiment of the apparatus according to the invention, in a view similar to FIG. 1.
Figure 4:
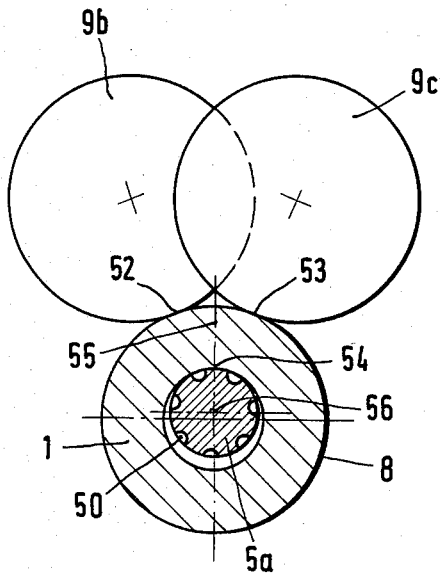
FIG. 4 is a section along the line IV—IV in FIG. 3.

In the apparatus according to FIGS. 3 and 4, the axial advance movement is effected by the grinding spindle 4*a* (arrow 39). The workpiece 1 is guided and held in the axial direction by an axial bearing 40, which has the configuration of a hydrostatically acting thrust bearing and is arranged on the frontal side 41 of the workpiece 1 facing away from the grinding spindle 4*a*. An annular groove 42 concentric with the coolant and lubricant nozzle 18*a* is provided, which is supplied with liquid under pressure through a supply channel 43.

The thrust bearing 40 and the nozzle 18*a* are of a simple, single piece configuration, with the coolant and lubricant serving as the pressure liquid. The hydrostatic thrust bearing may have a different configuration, when, for example, only one line is provided for the supply of the coolant and lubricant. From this, a branch line is provided for carrying a partial flow of the lubricant to the annular groove.

The advance of the grinding spindle (arrow 39) and the control and setting of an optimum grinding pressure may be regulated simply by means of the bearing thrust occurring during processing. The bearing thrust is measured by a measuring instrument, for example a manometer, and passed to an evaluating and regulating device 45, connected with the advance control device 46 for the grinding spindle 4*a*.

It is particularly advantageous to run the grinding spindle 4*a* against a stationary stop (not shown). Thus, only the grinding pin 5*a* is run rapidly into the bore 2 of the workpiece, and the thrust bearing 40 is subsequently displaced axially during the working advance (arrow 47). In this case the evaluating unit 45 is actively connected with an advance device (not shown) for the thrust bearing 40.

As further shown in FIG. 3, the holding and guiding part having the configuration of the grinding pin 5*a* is provided on both ends with bearing surfaces 7*a* and 7*b*, adjacent partial sections 48 and 49, in which the outer diameter of the pin is reduced by turning. These bearing surfaces are resting against the terminal areas of the workpiece bore 2. The bearing surfaces 7*a* and 7*b* have grooves 50 in the circumferential direction and uniformly spaced apart, extending in the axial direction of the grinding pin 5*a* and in an oblique or helical manner relative to the grinding spindle 4*a*, so that each groove 50 forms a section of an imaginary circumferential helix. As the result of this configuration, the bearing surfaces 7*a* and 7*b* possess several sliding surfaces, whereby the workpiece 1 is guided in an especially favorable manner. The direction of the grooves 50 is adapted to the direction of rotation of the grinding pin 5*a*, whereby a pumping effect supporting the flow (arrow 51) of the coolant and lubricant is generated. The grooves 50, viewed transversely to the spindle axis 56, are at an acute angle of approximately 15° with such axis. In addition, one groove of the bearing surface 7*a* is always aligned approximately with a groove of the other bearing surface 7*b*.

For the guidance without play and holding of the workpiece 1 on the grinding pin 5*a*, according to FIG. 4 two drive rolls 9*b* and 9*c* are provided, which are located on the circumferential surface 8 of the workpiece 1 axially following each other, so that, when viewed in the axial direction of the workpiece 1, they are partially superposed on each other. The pressure rolls 9*b* and 9*c* are further arranged so that their contact lines 52 and 53 with the circumferential surface 8 are symmetrical to a longitudinal center plane 55 of the workpiece 1 containing the contact line 54 of the grinding pin 5*a* with the workpiece bore 2. The imaginary tangential planes of the contact lines 52 and 53 form with the contact line 54 an acute angle of approximately 60°.

I claim:

1. Grinding apparatus for the precision machining of an internally formed sealing surface of a generally cylindrical workpiece, comprising:

(a) a grinding spindle, and means for rotating said spindle in a first direction, (b) a grinding pin rigidly secured to said spindle, the diameter of said pin being smaller than the diameter of said spindle, (c) a grinding tool carried on the free end of said pin and adapted to engage and grind the valve seat or sealing surface, (d) said workpiece being positioned over said pin in direct supporting engagement therewith, the internal diameter of said workpiece being greater than the diameter of said pin whereby said pin is located eccentrically in the bore of said workpiece, the longitudinal positioning of said workpiece relative to said pin being such that the leading end of said tool can engage the surface of said workpiece during the grinding operation, (e) holding and driving means engaging the outer surface of said workpiece for pressing the same against said pin and rotating the same in a second direction opposite to the direction of rotation of said spindle and pin carried thereby, and wherein (f) said spindle is located outside the bore of said workpiece.

2. Apparatus according to claim 1, characterized in that the diameter of the grinding spindle is at least two to four times larger than the diameter of said pin.

3. Apparatus according to claim 1, characterized in that said pin is cylindrical.

4. Apparatus according to claim 1 wherein said holding and driving means comprises at least one drive roll, with said drive roll having an axis which is oblique, at an angle of 2° to 5°, to the longitudinal axis of the workpiece.

5. Apparatus according to claim 1, wherein said holding and driving means comprises two drive rolls arranged axially along the surface of the workpiece in a manner so that they are overlapping in an axial direction.

6. Apparatus according to claim 5, characterized in that engagement of the drive rolls with the circumferential surface of the workpiece are along contact lines which are symmetrical with respect to a longitudinal center plane extending through the line of contact between said pin and said workpiece.

7. Apparatus according to claim 1, further including a coolant system from which coolant and lubricant may be introduced under pressure through an orifice of the workpiece into a cutting zone wherein said grinding tool engages said sealing surface, said coolant system including a nozzle arranged at a distance in front of the workpiece orifice and aligned with it.

8. Apparatus according to claim 7, further including a collector for the coolant and lubricant, said collector comprising a box-like container with passage orifices for the grinding spindle and the workpiece, said workpiece and the end of the spindle facing the workpiece protruding into the collector, said collector having a cover part arranged between the workpiece and the adjacent end of the spindle.

9. Apparatus according to claim 1, wherein said workpiece has an outer end, and further including an axial bearing for the workpiece, said bearing comprising a hydrostatically acting thrust bearing positioned closely adjacent said outer end of said workpiece.

10. Apparatus according to claim 9, characterized in that the axial bearing is formed with a supply line for coolant and lubricant for use in the grinding process.

11. Apparatus according to claim 10, wherein said supply line opens directly into a recess of said thrust bearing.

12. Apparatus according to claim 1, wherein said pin has at least two bearing surfaces spaced apart axially from each other.

13. Apparatus according to claim 12, wherein said pin has two ends and said bearing surfaces are located on said ends, with the outer diameter of a partial section of the pin located between the bearing surfaces being smaller than the diameter of said bearing surface.

14. Apparatus according to claim 12, wherein said bearing surfaces are formed with longitudinal grooves spaced apart uniformly in the circumferential direction.

* * * * *